US010608415B2

(12) United States Patent
Schumm et al.

(10) Patent No.: US 10,608,415 B2
(45) Date of Patent: Mar. 31, 2020

(54) CONNECTOR PLUG FOR CONNECTING AN IGNITION COIL TO A SPARK PLUG

(71) Applicant: BorgWarner Ludwigsburg GmbH, Ludwigsburg (DE)

(72) Inventors: Sven Schumm, Walheim (DE); Manfred Adolf, Schwaikheim (DE); Manuel Bauer, Ludwigsburg (DE); Dirk Wüstenhagen, Auma (DE); Alexander Stark, Althengstett (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 0 days.

(21) Appl. No.: 16/190,428

(22) Filed: Nov. 14, 2018

(65) Prior Publication Data

US 2019/0157846 A1 May 23, 2019

(30) Foreign Application Priority Data

Nov. 17, 2017 (DE) ..... 10 2017 127 174
Apr. 9, 2018 (DE) ..... 10 2018 108 292

(51) Int. Cl.

| | |
|---|---|
| ***H01T 13/04*** | (2006.01) |
| ***F02P 3/02*** | (2006.01) |
| ***H01F 27/28*** | (2006.01) |
| ***H01F 38/12*** | (2006.01) |

(52) U.S. Cl.

CPC ..... *H01T 13/04* (2013.01); *F02P 3/02* (2013.01); *H01F 27/2828* (2013.01); *H01F 38/12* (2013.01)

(58) Field of Classification Search

CPC ..... H01T 13/04
USPC ..... 439/125–128
See application file for complete search history.

(56) References Cited

U.S. PATENT DOCUMENTS

| | | | | | |
|---|---|---|---|---|---|
| 3,803,529 | A | * | 4/1974 | Rohrig | H01R 24/20 439/126 |
| 4,234,757 | A | * | 11/1980 | Simons | H01R 13/53 174/73.1 |
| 4,514,712 | A | * | 4/1985 | McDougal | H01F 38/12 123/169 PA |
| 4,671,586 | A | * | 6/1987 | DeBolt | H01T 13/05 439/126 |
| 4,701,662 | A | * | 10/1987 | Yamanashi | H01T 13/04 313/135 |
| 4,810,198 | A | * | 3/1989 | Sturdevan | H01T 13/04 439/125 |

(Continued)

FOREIGN PATENT DOCUMENTS

| | | |
|---|---|---|
| DE | 10 2011 082 231 A1 | 7/2012 |
| DE | 10 2015 110 309 A1 | 12/2016 |

(Continued)

*Primary Examiner* — Ross N Gushi
(74) *Attorney, Agent, or Firm* — Bose McKinney & Evans LLP

(57) ABSTRACT

A connector plug is described for connecting an ignition coil to a spark plug, comprising an electrical conductor, which has a first end for contacting the ignition coil and a second end for contacting the spark plug, and a protective tube, which surrounds the electrical conductor. In accordance with this disclosure it is proposed that the protective tube has a predetermined bending point with a reduced bending stiffness.

7 Claims, 5 Drawing Sheets

(56) References Cited

U.S. PATENT DOCUMENTS 4,884,977 A * 12/1989 Sturdevan ..... H01T 13/04 439/125
4,906,202 A * 3/1990 Germ ..... H01T 13/04 439/125
4,947,809 A * 8/1990 Hocking ..... H01T 13/06 123/169 PA
4,997,380 A * 3/1991 Etienne ..... H01T 13/04 439/127
5,026,294 A * 6/1991 Hisatomi ..... H01R 13/631 439/125
5,178,550 A * 1/1993 Fusselman ..... H01R 13/629 439/125
5,181,856 A * 1/1993 Vente ..... H01T 13/04 439/125
5,226,837 A * 7/1993 Cinibulk ..... H01R 13/5216 439/521
5,280,136 A * 1/1994 Yaworski ..... H02G 15/068 174/73.1
5,324,207 A * 6/1994 Itoh ..... H01T 13/06 439/125
5,357,233 A * 10/1994 Wada ..... H01F 38/12 123/634
5,370,100 A * 12/1994 Benedikt ..... H01T 13/04 123/643
5,382,170 A * 1/1995 Imanishi ..... F02P 3/02 123/169 PH
5,411,006 A * 5/1995 Noble ..... F02P 3/02 123/634
5,419,300 A * 5/1995 Maruyama ..... F02P 3/02 123/634
5,456,609 A * 10/1995 Imanishi ..... H01T 13/06 439/125
5,476,695 A * 12/1995 Okada ..... C08L 81/02 123/169 PA
5,487,676 A * 1/1996 Maruyama ..... F02P 3/02 324/399
5,537,983 A * 7/1996 Nakajima ..... F02P 3/02 123/169 PA
5,599,195 A * 2/1997 Mitani ..... H01T 13/04 439/125
5,603,306 A * 2/1997 Tai ..... H01B 7/0063 123/633
5,618,193 A * 4/1997 Nakajima ..... H01T 13/06 439/125
5,649,830 A * 7/1997 Ellsom ..... H01T 13/06 439/127
5,655,491 A * 8/1997 Nishiyama ..... H01T 13/04 123/169 PA
5,682,865 A * 11/1997 Maekawa ..... F02P 3/02 123/169 PA
5,685,282 A * 11/1997 Murata ..... F02P 3/02 123/169 PA
5,716,223 A * 2/1998 Phillips, Jr. ..... H01T 13/06 439/125
5,823,802 A * 10/1998 Bartley ..... G01L 23/10 439/86
5,827,079 A * 10/1998 Murata ..... F02P 3/02 439/125
5,842,458 A * 12/1998 Alstrin ..... F02P 13/00 123/635
5,886,294 A * 3/1999 Scrimpshire ..... G02B 6/3887 174/359
5,971,776 A * 10/1999 Neel ..... H01R 13/53 439/125
6,007,378 A * 12/1999 Oeth ..... H01R 13/5213 439/279
6,023,215 A * 2/2000 Sakamaki ..... F02P 3/02 123/634
6,273,733 B1 * 8/2001 Uchiyama ..... H01T 13/04 439/125
6,340,303 B2 * 1/2002 Hamada ..... H01R 13/2421 439/127
6,358,072 B1 * 3/2002 Johnson ..... H01R 13/53 123/169 PH
6,501,360 B2 * 12/2002 Martagni ..... H01T 13/05 336/90
6,668,810 B1 * 12/2003 St. John ..... F02P 3/02 123/634
6,679,236 B2 * 1/2004 Skinner ..... F02P 13/00 123/634
6,724,289 B2 * 4/2004 Moga ..... H01F 27/362 123/634
6,886,514 B2 * 5/2005 Matsuda ..... F02F 1/242 123/143 C
6,932,627 B2 * 8/2005 Raff ..... H01T 13/04 439/125
7,036,495 B1 * 5/2006 Shimizu ..... H01T 13/05 123/260
7,213,588 B2 * 5/2007 Iwa ..... F02P 3/02 123/633
7,317,370 B2 * 1/2008 Nakamoto ..... H01F 38/12 123/634
7,383,830 B2 * 6/2008 Matsui ..... H01F 27/29 123/143 B
7,646,277 B2 * 1/2010 Tsunenaga ..... H01F 38/12 123/634
7,681,563 B2 * 3/2010 Idogawa ..... H01F 38/12 123/634
7,838,775 B2 * 11/2010 Montena ..... H01R 13/5213 174/138 F
7,849,843 B2 * 12/2010 Kojima ..... H01F 38/12 123/635
8,033,273 B2 * 10/2011 Kato ..... F02P 23/04 123/596
8,061,337 B2 * 11/2011 Maekawa ..... H01T 13/44 123/143 C
8,066,520 B2 * 11/2011 Lenfert ..... H01R 4/2404 439/125
8,108,968 B2 * 2/2012 Pietryga ..... H02G 3/0468 16/2.1
8,151,781 B2 * 4/2012 Lykowski ..... H01T 13/04 123/143 B
8,221,140 B2 * 7/2012 Schneider ..... H01R 13/193 439/125
8,225,775 B1 * 7/2012 Idogawa ..... H01F 38/12 123/634
8,388,359 B1 * 3/2013 Mahoney ..... H01R 13/2464 439/125
8,474,428 B2 * 7/2013 Lykowski ..... H01T 13/04 123/143 B
8,499,751 B2 * 8/2013 Idogawa ..... F02P 15/00 123/634
8,529,288 B2 * 9/2013 Montena ..... H01R 13/5213 439/523
8,839,752 B2 * 9/2014 Burrows ..... H01T 13/50 123/143 B
8,851,915 B2 * 10/2014 Fuma ..... H01T 13/06 439/272
8,853,542 B2 * 10/2014 Anderson ..... H01R 13/5213 174/138 F
9,117,585 B2 * 8/2015 Skinner ..... H01F 27/28
9,160,120 B2 * 10/2015 Schulze ..... H01R 24/38
9,194,359 B2 * 11/2015 Steinberger ..... F02P 13/00
9,216,530 B2 * 12/2015 Vaccaro ..... H02G 15/013
9,281,663 B2 * 3/2016 Johnson ..... H01T 13/05
9,356,433 B2 * 5/2016 Lewandowski ..... H01T 13/05
9,608,361 B2 * 3/2017 Vaccaro ..... H01R 13/5205
9,616,602 B2 * 4/2017 Vaccaro ..... H02G 1/14
9,653,895 B2 * 5/2017 Vaccaro ..... H02G 3/0487
9,912,124 B2 * 3/2018 Tamas ..... H01T 13/05
9,917,394 B2 * 3/2018 Natoli ..... H01R 13/5213
9,923,300 B2 * 3/2018 Marrs ..... H01R 13/53
9,938,952 B2 * 4/2018 Akimoto ..... H01F 38/12
9,941,624 B2 * 4/2018 Zhang ..... H01R 13/5221
9,947,463 B2 * 4/2018 Akimoto ..... F02P 3/02
10,008,830 B2 * 6/2018 Marrs ..... H01T 13/04
10,012,203 B2 * 7/2018 Sano ..... F02P 13/00
10,037,846 B2 * 7/2018 Akimoto ..... H01F 38/12
10,079,475 B2 * 9/2018 Ohta ..... H01R 13/533

(56) References Cited

U.S. PATENT DOCUMENTS 10,084,291 B2 * 9/2018 Carlson ..... F02P 13/00
10,090,661 B2 * 10/2018 Vaccaro ..... F16J 15/025
10,164,410 B2 * 12/2018 Andersson ..... F02P 3/02
10,164,419 B2 * 12/2018 Vaccaro ..... H02G 1/14
10,270,238 B2 * 4/2019 Vaccaro ..... F16J 15/025
10,291,000 B2 * 5/2019 Sugiura ..... F02P 13/00
2002/0014939 A1 * 2/2002 Martagni ..... H01T 13/05 336/90
2002/0028593 A1 * 3/2002 Uchiyama ..... H01R 24/20 439/125
2002/0067233 A1 * 6/2002 Kondo ..... H01F 38/12 336/96
2002/0101701 A1 * 8/2002 Moga ..... F02P 3/02 361/247
2003/0070664 A1 * 4/2003 Skinner ..... F02P 13/00 123/634
2006/0089024 A1 * 4/2006 Kraus ..... H01T 13/05 439/125
2006/0260591 A1 * 11/2006 Iwa ..... F02P 3/02 123/634
2007/0181109 A1 * 8/2007 Matsui ..... F02P 3/02 123/634
2008/0274632 A1 * 11/2008 Lenfert ..... H01R 4/2404 439/125
2009/0033451 A1 * 2/2009 Akimoto ..... H01F 5/04 336/96
2009/0289752 A1 * 11/2009 Akimoto ..... H01B 3/40 336/222
2010/0248533 A1 * 9/2010 Montena ..... H01R 13/5213 439/521
2012/0161604 A1 * 6/2012 Lykowski ..... H01T 13/04 313/118
2012/0222660 A1 * 9/2012 Idogawa ..... H01F 27/33 123/634
2013/0293332 A1 * 11/2013 Skinner ..... H01F 27/02 336/90
2013/0312721 A1 * 11/2013 Yamauchi ..... F02P 3/01 123/634
2014/0097022 A1 * 4/2014 Vaccaro ..... B29C 45/261 174/77 R
2014/0154901 A1 * 6/2014 Schulze ..... H01T 13/04 439/125
2014/0295703 A1 * 10/2014 Nagashima ..... H01R 13/502 439/607.01
2015/0136439 A1 * 5/2015 Vaccaro ..... H02G 3/0487 174/91
2015/0167622 A1 * 6/2015 Skinner ..... H01F 41/04 123/634
2016/0211072 A1 * 7/2016 Kawai ..... H01F 38/12
2017/0016422 A1 * 1/2017 Akimoto ..... H01F 38/12
2017/0207616 A1 * 7/2017 Vaccaro ..... H02G 1/14
2017/0321648 A1 * 11/2017 Sano ..... H01F 38/12
2018/0030947 A1 * 2/2018 Anderson ..... F02F 1/00
2018/0108473 A1 * 4/2018 Akimoto ..... H01F 38/12
2018/0294092 A1 * 10/2018 Sato ..... F02P 13/00
2018/0309268 A1 * 10/2018 Idogawa ..... H01T 13/04
2019/0157846 A1 * 5/2019 Schumm ..... H01T 13/04

FOREIGN PATENT DOCUMENTS

JP 2011-134857 A 7/2011
WO WO 2010/149194 A1 12/2010
WO WO 2012/095252 A1 7/2012

* cited by examiner

CONNECTOR PLUG FOR CONNECTING AN IGNITION COIL TO A SPARK PLUG

RELATED APPLICATIONS

This application claims priority to DE 10 2017 127 174.0, filed Nov. 17, 2017, and also claims priority to DE 10 2018 108 292.4, filed Apr. 9, 2018, both of which are incorporated herein by reference in their entirety.

BACKGROUND AND SUMMARY

This disclosure is based on a connector plug for connecting an ignition coil to a spark plug. Connector plugs of this type are generally known from DE 10 2011 082 231 A1, JP 2011-134857 A and DE 10 2015 110 309 A1, for example.

Depending on the geometric conditions on an engine, connector plugs with either a straight or a curved protective tube are required. The production of both straight and curved protective tubes is expensive. There is therefore a need for connector plugs that can be bent as required, such as the connector plug of known art from JP 2011-134857 A.

This disclosure shows how a connector plug for connecting a spark plug to an ignition coil can be produced cost-effectively, which—if required—can also be mounted in a curved state on an engine with little effort, and is protected from damage by a mechanically robust protective tube.

The protective tube of an inventive connector plug has a predetermined bending point with a reduced bending stiffness. If the connector plug is to be used in a curved state, the protective tube can easily be bent in the desired manner at the one or more bending points, so that the connector plug can be used in either a straight configuration or a curved configuration. In the simplest case, the predetermined bending point can be embodied as a groove or a notch in the outer surface of the protective tube.

In an advantageous refinement of this disclosure the protective tube has a plurality of mutually adjacent reinforcement ribs extending in its longitudinal direction, wherein the predetermined bending point is designed as a recess, or other weakening feature, in one or a plurality of these reinforcement ribs. All the reinforcement ribs, some of the reinforcement ribs, or even just one reinforcement rib, may have such a recess.

It is preferable that reinforcement ribs on opposite sides of the protective tube have a predetermined bending point in the form of a recess, but that reinforcement ribs located in between them have no recess. In this manner, the bending stiffness of the protective tube is reduced only where it is necessary, namely on the inner and outer radius of the intended bend.

The protective tube can have, for example, four reinforcement ribs, wherein two opposing reinforcement ribs have the predetermined bending point, and the two reinforcement ribs located in between them have no predetermined bending point at the corresponding position. The recess forming a predetermined bending point can, for example, be designed in the form of a notch, a rectangular shape, or a U-shaped recess.

In another advantageous refinement of this disclosure the outer surface of the protective tube is closed in the vicinity of the predetermined bending point. In this manner, the protective function of the protective tube is not impaired by the predetermined bending point. In particular, the protective tube can then also fulfil the function of electrical insulation such that no additional electrical insulation is required. In principle, the protective tube can, however, also fulfil its function, albeit to a limited extent, if the predetermined bending point forms an opening in the outer surface of the protective tube, for example a slot passing through its wall.

In another advantageous refinement the protective tube has, at a distance from the predetermined bending point, a section that has an increased wall thickness. In the vicinity of the predetermined bending point, on the other hand, the wall thickness of the protective tube between the reinforcement ribs can be reduced.

The protective tube of an inventive connector plug can have a plurality of predetermined bending points, which are arranged at a distance from each other in the axial direction. However, the protective tube preferably only has one predetermined bending point at one height.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
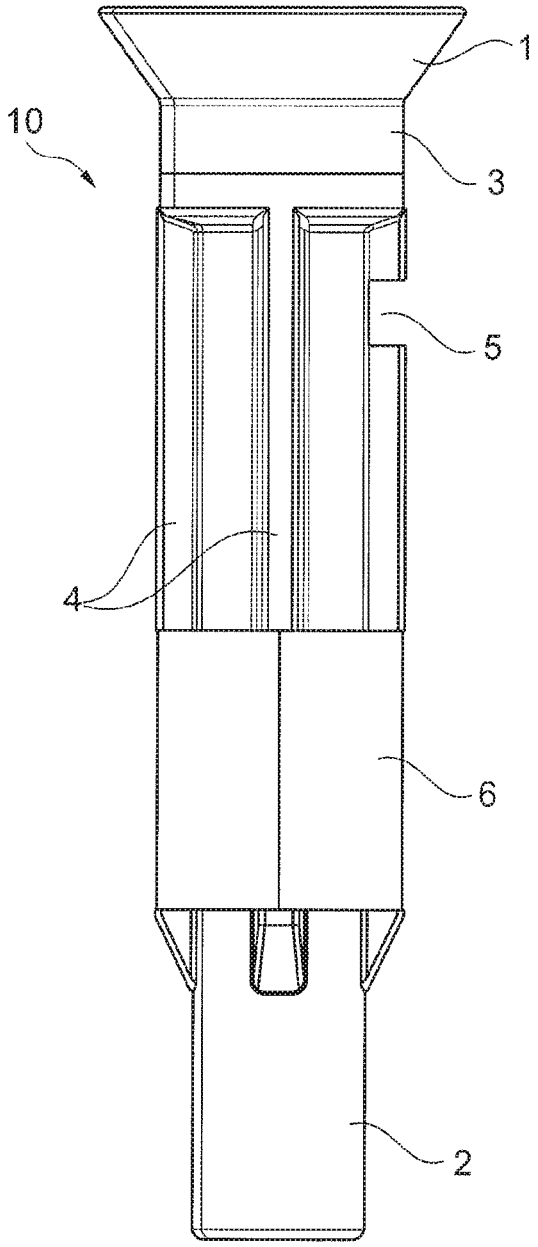
FIG. 1 shows an example of embodiment of an inventive connector plug.
Figure 2:
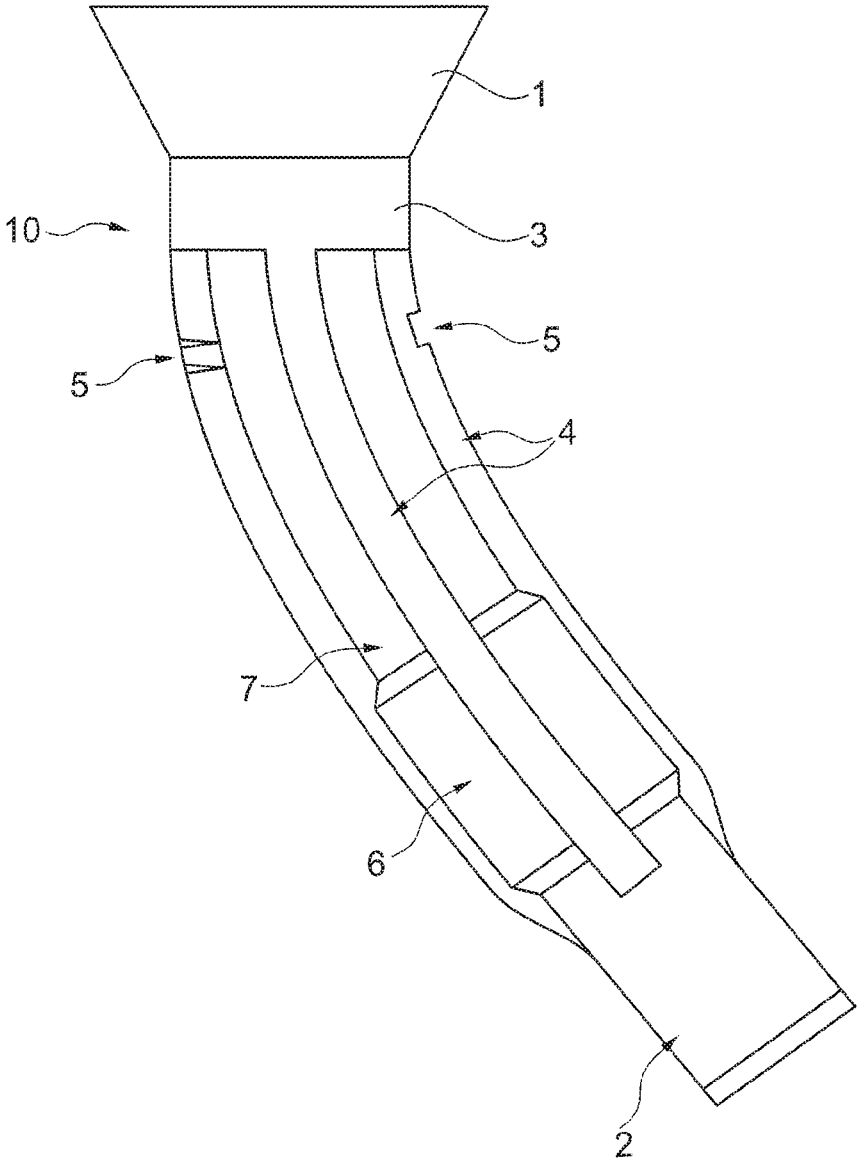
FIG. 2 shows the connector plug shown in FIG. 1 in a curved state.
Figure 3:
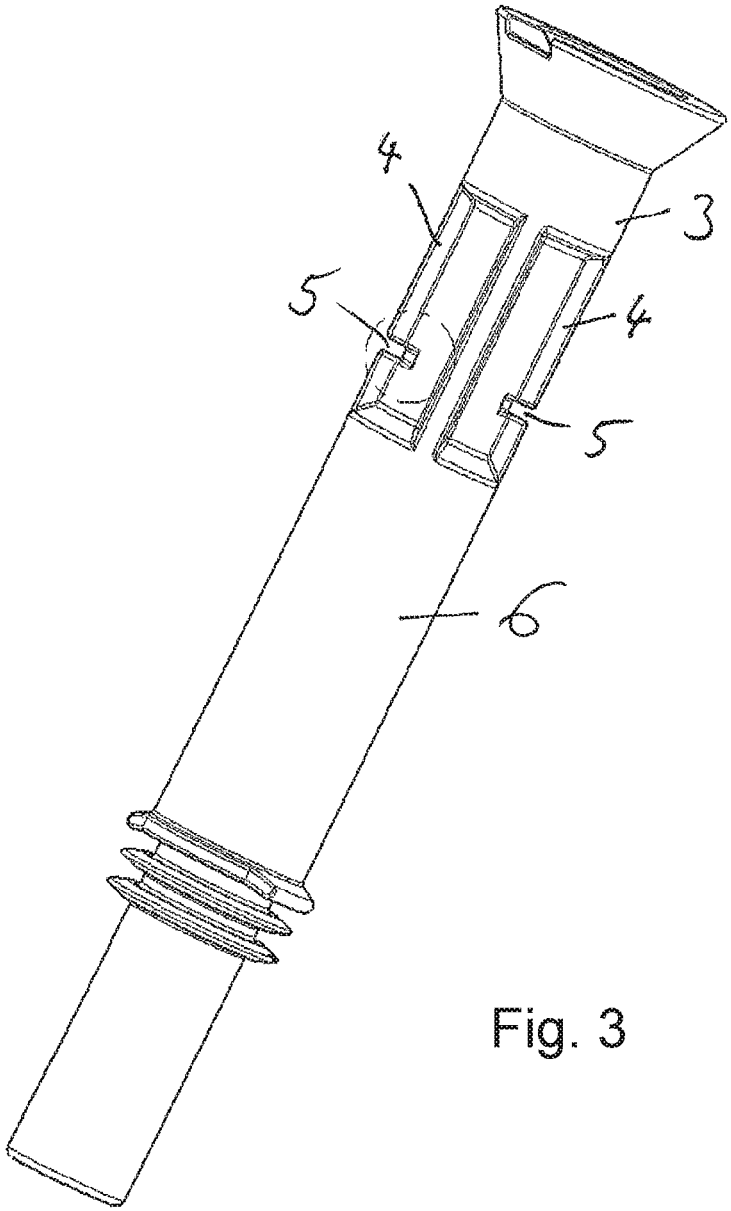
FIG. 3 shows another example of embodiment of a protective tube for a connector plug.
Figure 4:
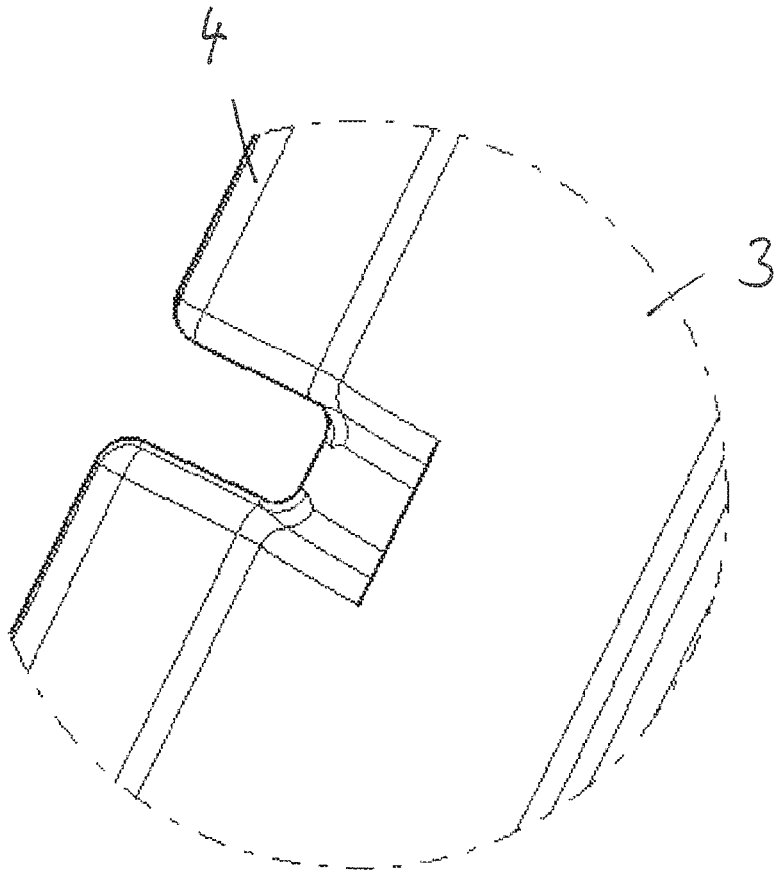
FIG. 4 shows a detail of FIG. 3.
Figure 5:
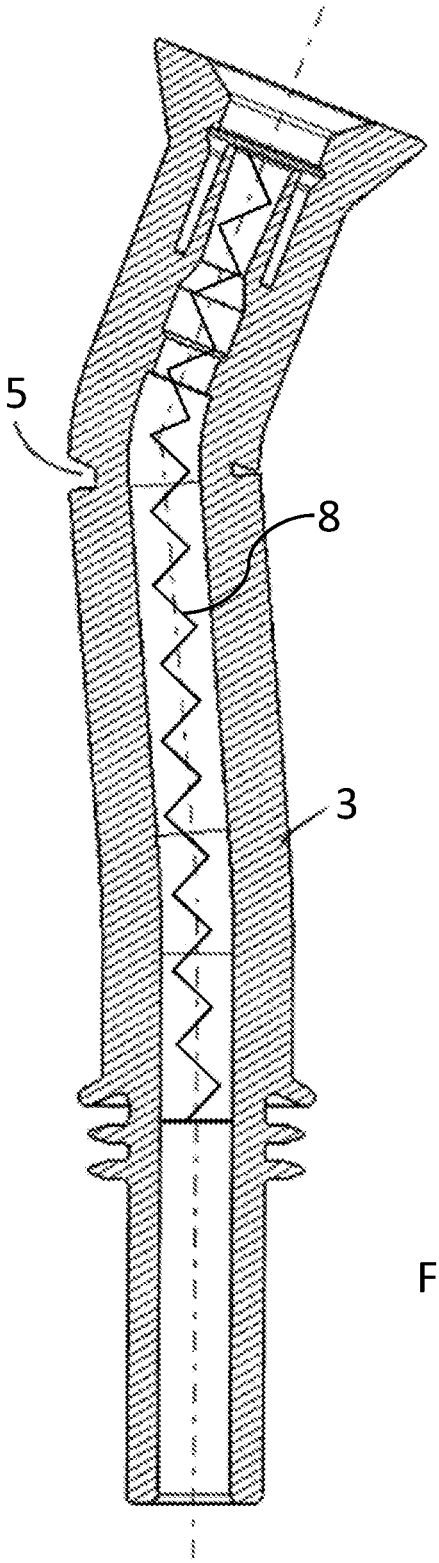
FIG. 5 shows a cross-sectional view of the protective tube shown in FIG. 3 in a curved state.

The connector plug 10 shown in FIG. 1 is used to connect an ignition coil to a spark plug of an internal combustion engine. For this purpose, the upper end 1 of the connector plug 10 in the figures is connected to the ignition coil, and the lower end 2 in the figures is connected to the spark plug. The connector plug 10 contains an electrical conductor 8 (shown schematically in FIG. 5), for example in the form of a metallic coil spring, which is surrounded by a protective tube 3, and in operation connects the high-voltage contact of an ignition coil to the terminal contact of a spark plug in an electrically conducting manner. The protective tube 3 can be seen in FIGS. 1 and 2, and may be made of silicone, for example. A further example of embodiment of the protective tube 3 is shown in FIGS. 3 to 5.

The protective tube 3 has a plurality of reinforcement ribs 4, which, located side by side around its circumference, extend parallel to its longitudinal direction. In the example of embodiment of FIGS. 1 and 2, the reinforcement ribs 4 extend over the majority of the protective tube 3, for example over three quarters of its length or more. The reinforcement ribs increase the mechanical load-bearing capacity of the protective tube 3, and are preferably dimensioned such that they can support the connector plug 10 on a cylinder head bore of an engine. In addition, the space between the reinforcement ribs 4 facilitates air exchange in the cylinder head bore. At least one of the said reinforcement ribs 4 has a predetermined bending point formed by at least one recess 5.

The protective tube 3 can, for example, have four reinforcement ribs 4, wherein two of the said reinforcement ribs 4 each have predetermined bending points located opposite each other and formed by a recess 5. The two reinforcement ribs 4 located in between them have no recesses in the corresponding position. If the protective tube 3 is curved, one of the said two recesses 5 forming a predetermined bending point is then located on the inside of the curve and the opposing recess 5 is located on the outside of the curve. The recess 5 on the inside of the curve avoids compressive stresses in the reinforcement rib 4. The recess 5 located on the outside of the curve avoids tensile stresses in the corresponding reinforcement rib 4. The reinforcement ribs 4 without recesses located between the said two reinforcement ribs 4 with recesses 5 are only slightly affected by the curvature shown in FIG. 2 and therefore do not require any recesses 5.

In the example of embodiment shown, the recesses 5 have a rectangular shape, but can also be of a different shape, for example they can be wedge-shaped or U-shaped.

At a distance from the predetermined bending points formed by the recesses 5, the protective tube 3 has a section 6 with an increased wall thickness. The increased wall thickness can be thickened up to the height of the reinforcement ribs, as shown in FIG. 1, but can also protrude beyond, or be thinner than, the outer diameter of the reinforcement ribs, so that reinforcement ribs can also be formed in region 6. In this manner, the mechanical stability of the protective tube 3 can be improved. In section 7 of the protective tube 3 containing the recesses 5, the wall thickness between the reinforcement ribs 4 can be significantly reduced so as to save material and facilitate the bending of the protective tube 3.

The recesses 5 of the reinforcement ribs 4 are preferably not so deep that an opening is thereby created in the protective tube 3. The recesses 5 of the reinforcement ribs 4 are preferably approximately as deep as the height of the reinforcement rib. The remaining wall thickness must be thick enough to provide the necessary protection and insulation.

The width of the recess 5 or recesses 5 measured in the longitudinal direction of the reinforcement ribs 4 is preferably as large as, or larger than, the width of the reinforcement ribs 4 measured transversely to their longitudinal direction, but is not more than three times the width of the reinforcement ribs 4.

The width of the recess (measured at rib height) may approach zero on the outer radius of the bend; a narrow slot or cut may be sufficient, as the recess diverges during bending. The recess is preferably slightly wider, so that a bending radius can form at the base of the recess. On the inside of the bend, the width of the recess should be dimensioned so that, during bending, the inner walls of the recess do not come into contact with each other, or only with a low contact pressure.

Only a single recess 5 is shown in FIG. 1. However, a plurality of recesses 5 can also be provided on a reinforcement rib 4.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE SYMBOLS

1 End of connector plug adjacent to ignition coil
2 End of connector plug adjacent to spark plug
3 Protective tube
4 Reinforcement rib
5 Recess
6 Protective tube section
7 Protective tube section
8 Electrical conductor
10 Connector plug

What is claimed is:

1. A connector plug for connecting an ignition coil to a spark plug, comprising:

an electrical conductor having a first end configured for contacting the ignition coil and a second end configured for contacting the spark plug; and a protective tube surrounding the electrical conductor;

wherein the protective tube has a predetermined bending point with a reduced bending stiffness;

further wherein the protective tube has a plurality of reinforcement ribs extending in a longitudinal direction thereof, and wherein the predetermined bending point comprises a recess in one or a plurality of the reinforcement ribs.

2. The connector plug in accordance with claim 1, wherein one or more of the reinforcement ribs has no recess for reducing the bending stiffness.

3. The connector plug in accordance with claim 2, wherein the protective tube has four reinforcement ribs, wherein two opposing reinforcement ribs have a predetermined bending point comprising a recess, and two reinforcement ribs have no recess.

4. The connector plug in accordance with claim 1, wherein the width of the recess, measured in the longitudinal direction of the reinforcement ribs, is equal to or greater than the width of the reinforcement ribs measured transversely to their longitudinal direction.

5. The connector plug in accordance with claim 4, wherein the width of the recess measured in the longitudinal direction of the reinforcement ribs is not more than three times the width of the reinforcement ribs measured in their longitudinal direction.

6. The connector plug in accordance with claim 1, wherein the outer surface of the protective tube is closed in the vicinity of the predetermined bending point.

7. The connector plug in accordance with claim 1, wherein the protective tube has a section at a distance from the predetermined bending point in which its wall thickness is increased around its periphery.

* * * * *